United States Patent [19]

Rantala

[11] Patent Number: 4,948,465

[45] Date of Patent: Aug. 14, 1990

[54] METHOD AND APPARATUS FOR FACILITATING THE REPLACEMENT OF AN ENDLESS PRESS FELT IN A PAPER AND BOARD MAKING MACHINE

[75] Inventor: Mauri Rantala, Nokia, Finland

[73] Assignee: Oy Tampella Ab, Tampere, Finland

[21] Appl. No.: 352,531

[22] Filed: May 15, 1989

[30] Foreign Application Priority Data

May 23, 1988 [FI] Finland ..... 882416

[51] Int. Cl.[5] ..... D21F 3/00

[52] U.S. Cl. ..... 162/199; 162/274; 162/358

[58] Field of Search ..... 162/199, 200, 272, 273, 162/274, 358, 360.1

[56] References Cited

U.S. PATENT DOCUMENTS

| | | | |
|---|---|---|---|
| 3,547,776 | 12/1970 | Curtis | 162/274 |
| 4,036,683 | 7/1977 | Biondetti | 162/274 |
| 4,481,078 | 11/1984 | Niemi | 162/274 |
| 4,657,634 | 4/1987 | Autio | 162/273 |

*Primary Examiner*—Karen M. Hastings

*Attorney, Agent, or Firm*—Pollock, Vande Sande & Priddy

[57] ABSTRACT

An apparatus for facilitating the replacement of an endless press felt in a paper and board making machine includes an actuator for lifting a roll which is in contact with a press felt. The actuator operates to lower a roll holder carrying the second end of a roll. The apparatus also includes a roll support mounted on a section between roll ends and, through the intermediary of a lever, is pivotably linked to a fixed fulcrum on a base structure. The roll support is linked by means of a chain serving as a connecting member to the second end of the roll.

12 Claims, 4 Drawing Sheets

METHOD AND APPARATUS FOR FACILITATING THE REPLACEMENT OF AN ENDLESS PRESS FELT IN A PAPER AND BOARD MAKING MACHINE

BACKGROUND OF THE INVENTION

The present invention relates to a method for facilitating the replacement of an endless press felt or a like web in a paper and board making machine, in which method the first end of a roll communicating with the press felt or the like is carried from an intial position to a felt replacement position in a direction transverse to the longitudinal axis of the roll for providing space for the replacement of the felt while at the same time supporting the roll. The present invention relates also to an apparatus for facilitating the replacement of an endless press felt or a like web in a paper and board making machine, comprising an actuator means communicating with the press felt or the like and adapted to effect a transfer of the first end of a roll from an initial position to a felt replacement position in a direction transverse to the longitudinal axis of the roll as well as to provide support for the roll. The method and apparatus are used in a paper and board making machine for carrying the end of a roll inside the felt away from an intial position, wherein the roll lies horizontal and at its first end in communication with a support, to a felt replacement position, wherein a fresh felt can be threaded in the press with the roll turned aside such that there will be a suitable space between the first end and the support for the felt replacement operation.

This type of method and apparatus are disclosed, for example, in the U.S. Pat. No. 4,036,683. This apparatus is provided with an actuator which operates a hoist for lifting the first end of a roll. The other end of the roll is supported by a bracket arm which is swingable during the hoisting movement and which is fitted with the bearings of this end. A swinging bracket arm requires space in a lateral direction during the swinging movement. In addition, hoisting the end of a roll has been effected by using other actuators, such as a lifting jack, which makes the method difficult to carry out.

Another drawback in all prior art methods and devices has been the fact that they require a separate actuator which in turn requires its own control and operating equipment.

SUMMARY OF THE INVENTION

An object of the present invention is to provide a solution which is more useful than the prior art solutions and which offers advantages, such as simplicity, and which allows for employment of the actuators already available in the felt clamps of a press section. In order to achieve this objective, a method of the invention is mainly characterized in that a support is placed in a zone between the ends of a roll and the roll is turned around a fulcrum provided by the support for moving the first end of the roll to a felt replacement position. The swinging movement can be effected by applying to the second end of the roll a force which causes the second end of the roll to move in a direction transverse to the longitudinal axis of the roll, whereby this movement of the second end, by virtue of a fulcrum provided by the support, causes the roll to swing aside and the first end to travel in opposite direction. By means of the support placed within the roll section between the ends it is possible to provide a fulcrum, whereby the first roll end travels to a felt replacement position as the second roll end is moved by means of a suitable actuator, i.e. the roll is then tilted on the fulcrum from an initial position to a felt replacement position within the same space that is normally occupied in the cross-machine direction by a roll in its operating position. Another feature of the method is that the first roll end can also be carried to a felt replacement position by means of already existing actuators, such as a tension roll shifting motor.

An apparatus for practicing a method of the invention is mainly characterized in that a support is adapted to be positioned within the section of a roll between its ends. According to one preferred embodiment, the apparatus comprises an actuator which is in a force-transmitting communication with the second end of a roll for shifting it in a direction transverse to the longitudinal axis of the roll. By virtue of a support mounted within a section between the ends of a roll, this shifting motion of the second end effects the swinging of a roll around a fulcrum and a movement of the first end to a felt replacement position in a direction opposite to that of the second end.

According to one preferred embodiment of the apparatus, a roll support is connected to a lever which is pivotably linked to a fulcrum fixed securely to the base structure for readily swinging it to a supporting position against the roll. The roll support can be connected to the second roll end by means of a connecting member. Thus, the lever and the connecting member provide a leverage retaining a fixed position relative to the longitudinal axis of a roll. From a structural viewpoint the most practical solution is such that the connecting member is a tensile stress transmitting flexible component, such as a chain or a like.

BRIEF DESCRIPTION OF THE DRAWINGS

The invention will now be described in more detail with reference made to the accompanying drawings, in which.

DETAILED DESCRIPTION OF THE PREFERRED EMBODIMENTS

Figure 1:
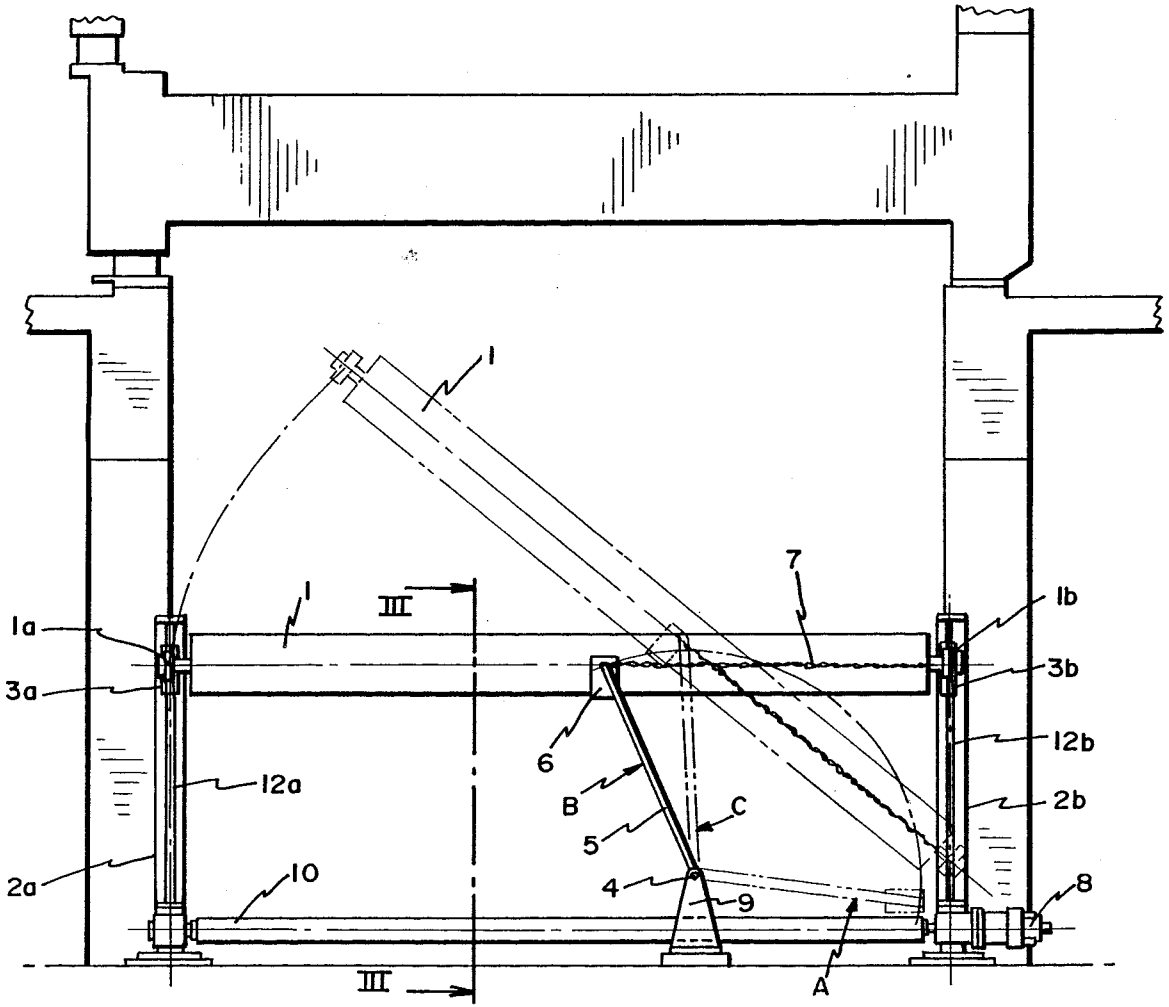
FIG. 1 shows an apparatus of the invention in machine direction as viewed perpendicularly to the longitudinal axes of the rolls of a press section.

FIG. 1 shows a roll 1 inside the endless press felt loop in the press section of a paper and board making machine, being mounted below the actual press rolls at the lowest spot of a loop formed by the press felt. The roll is provided with a first end facing the servide side and a second end facing the operating side. The bearings of both ends are mounted on upright brackets 2, a bracket facing the service side being indicated by reference numeral 2*a* and a bracket facing the operating side by reference numeral 2*b*. A roll end bearing system facing the service side is in turn indicated by reference numeral 1*a* and a roll end bearing system facing the operating side by reference numeral 1*b*. The roll bearing system 1*b* facing the operating side is mounted on a movable roll holder 3b and the bearing system 1a facing the service side is mounted on a movable roll holder 3a. The roll holders are carried in guides 12a and 12b made in brackets 2a and 2b by means of a shifting motor 8, whereby the roll 1 tensions the press felt.

Below the roll 1 is a support leg 5 adapted to be pivotable relative to a base-fixed fulcrum 4 in a vertical plane parallel to the longitudinal roll axis (axis of revolution of the roll), the opposite end of the legs being fitted with a pivotably mounted support saddle 6. By turning the support leg 5 the support saddle 6 can be brought against the bottom surface of roll 1 from a storage position A indicated by dash-and-dot lines to a supporting position B indicated by solid lines; so that the support saddle 6 lies against the roll mantle and thus supports roll 1 from below. The support leg 5 carrying a support saddle forms towards the operating side an obtuse angle relative to the horizontal plane, being inclined towards the service side, and the holding of saddle 6 below roll 1 is arranged in a manner that the point of articulation of the saddle is linked to a roll holder 3b on the operating side by means of a connecting member of a suitable length which in the present case is a chain 7.

Figure 3:
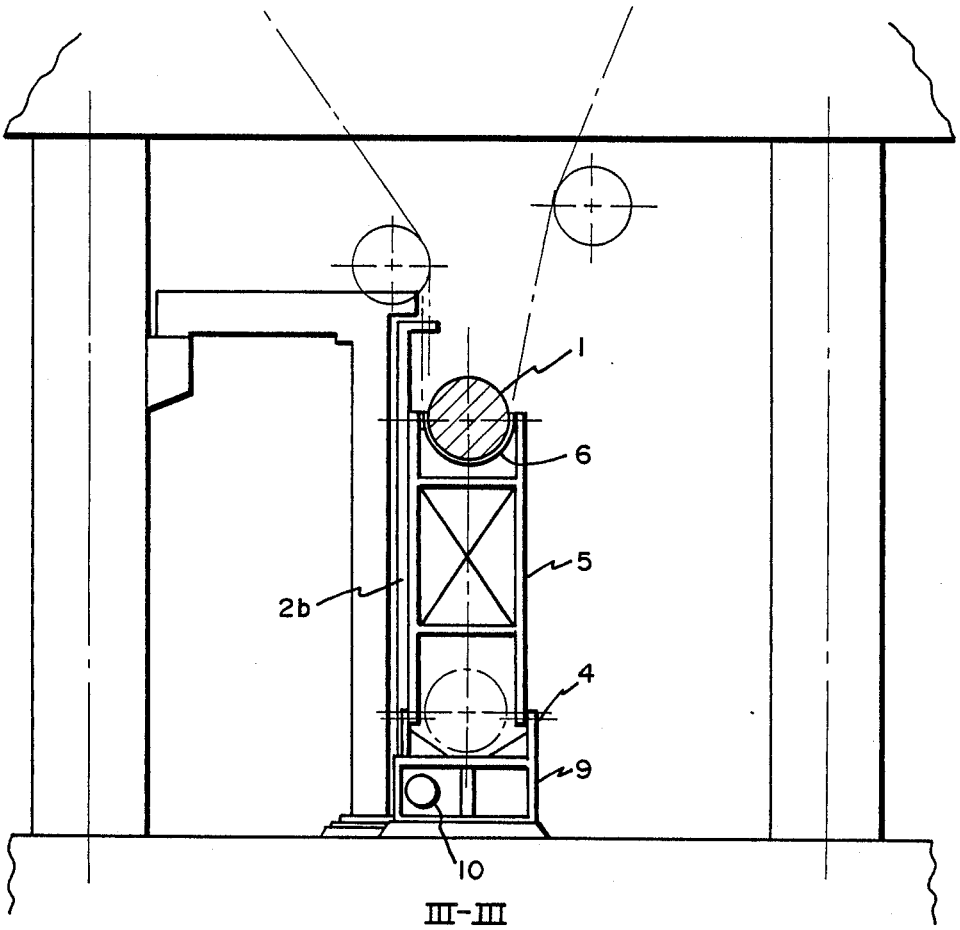
FIG. 3 is a side view of the apparatus in a section along the line III—III in FIG. 1 perpendicularly to the longitudinal axes of the rolls of a press section.

FIG. 3 illustrates the support leg and the saddle in a side view. The support leg 5 consists of two parallel legs linked together by cross-wise connecting bars and pivotably fastened at their bottom ends each to their own fulcrum 4 which are mounted on a base 9 fixed securely to the floor. The saddle 6 is pivotably mounted between the top ends of the legs.

FIG. 1 shows roll 1 in a horizontal initial position. A used felt has been removed from around the roll by cutting open the felt loop, whereafter roll 1 has been lifted up by means of a shifting motor 8. At the same time, roll holders 3a and 3b travel in their guides since the shifting motion of motor 8 is transmitted to the service side by means of an intermediate shaft 10 extending between the bottom guide ends and the roll remains at all times horizontal when it is secured at its ends to the roll holders.

Whenever roll 1 is tilted to a felt replacement position, the support saddle 6 is swung into a supporting position B and the service side bearing system 1a is detached from roll holder 3a whereafter this end of a roll is free to travel in a vertical plane. The operating side roll holder 3b is lowered down by means of shifting motor 8, whereby the operating side roll bearing system 1b mounted thereon travels downwards at the same time and the service side roll holder 3a loosened from bearing system 1a travels downwards at the same time. Since the saddle 6 serving as a fulcrum lies against the mantle surface of roll 1 within a section between bearing systems 1a and 1b, the lowering of the end 1b results respectively in the rising of the 1a and the roll will be tilted to a felt replacement position shown by dash-and-dot lines. In addition, a connecting member 7 assumes that the position of saddle 6 relative to the longitudinal axis of roll 1 remains unchanged since support leg 5 and connecting member 7 can be thought to form a fixed linkage and hence roll 1 does not slide along saddle 6 during a tilting movement. Thus, along with the tilting movement, the support leg 5 travels to a position C shown in the figure by dash-and-dot lines.

Around the upper press section rolls inside a felt loop a fresh felt can be threaded by using prior known techniques, for example, by removing a part of the service side end bracket as disclosed in the U.S. Pat. No. 4,036,683.

Figure 2:
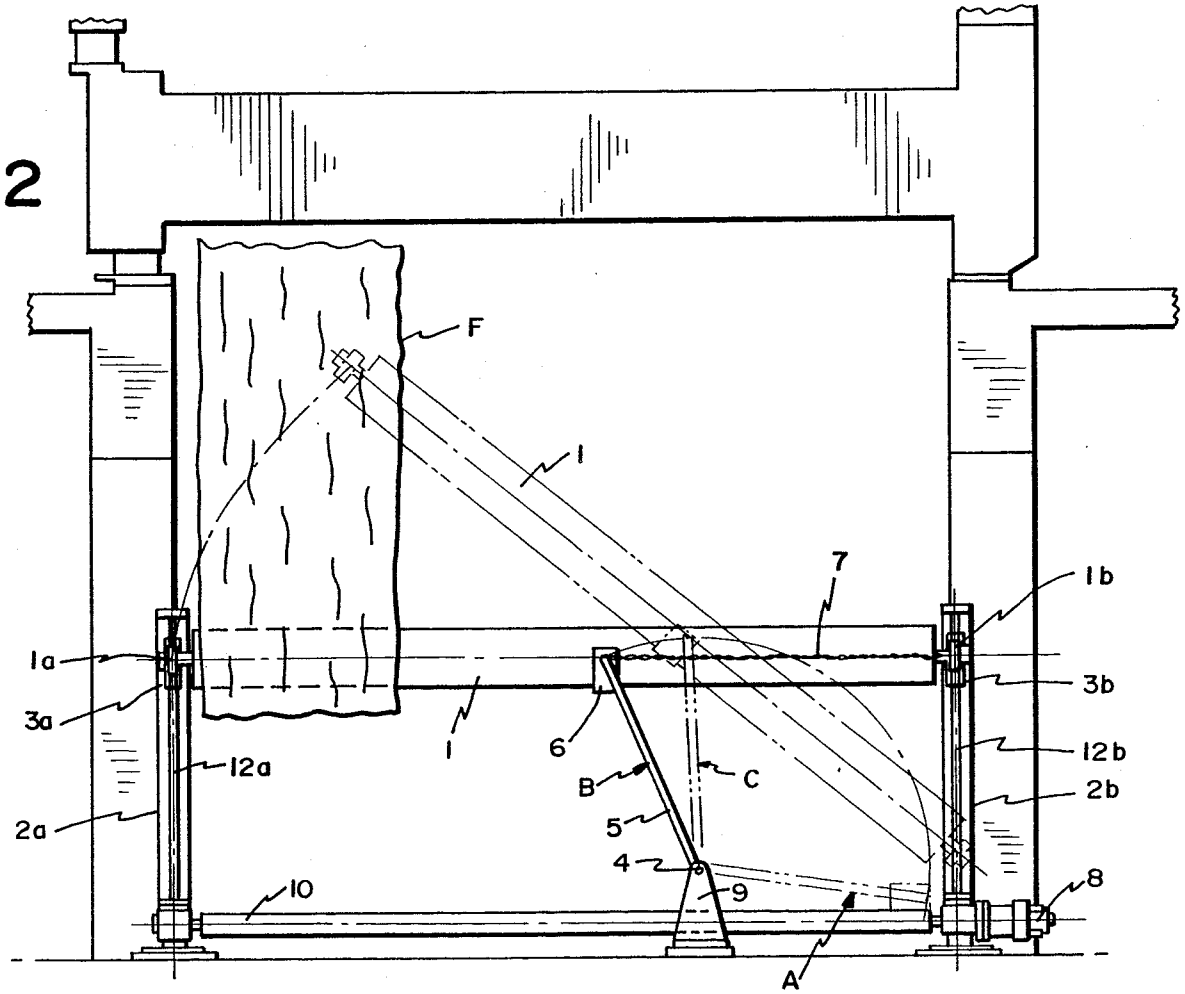
FIG. 2 shows the apparatus of FIG. 1 in a condition in which a fresh felt has been threaded in position.

With roll 1 in position C, a fresh felt loop F can be threaded between guide 2a and roll end 1a within a section between guide 2a and support saddle 6 followed by lifting up the operating side roll holder 3b, returning the roll to a horizontal position which it had prior to the unfastening of the service side bearing system 1a, and by mounting the bearing system 1a back on its roll holder 3a (FIG. 2). Thereafter, the support leg is swung down and support saddle 6 is no longer in the way so that the felt can be extended to its full width around roll 1 and tensioned by lowering the roll by means of a shifting motor.

The felt replacement apparatus does not require any extra actuators or controllers since the roll means can be tilted by means of a hitch roll shifting motor 8 already available on the operating side. The only auxiliary equipment required by the invention is an inclination support comprising the support leg 5, saddle 6 and connecting member 7. The support saddle 6 mounted on the end of support leg 5 can be always brought to a suitable level by fastening the connecting member 7 to roll holder 3b at a suitable point. Since the purpose of the connecting member 7 is primarily to maintain support leg 5, as well as the saddle carried thereby, against the roll 1 by preventing the support leg from swinging towards service side bearing system 1a, it is sufficient that the connecting member comprises a tensile stress transmitting member, a chain being particularly suitable for the purpose and a cable being another possibility. However, a connecting member is not absolutely necessary as it is not always necessary to prevent the sliding of roll 1 in a saddle and, thus, the saddle can be articulated to a support leg having a fixed position during a tilting movement.

Figure 4B:
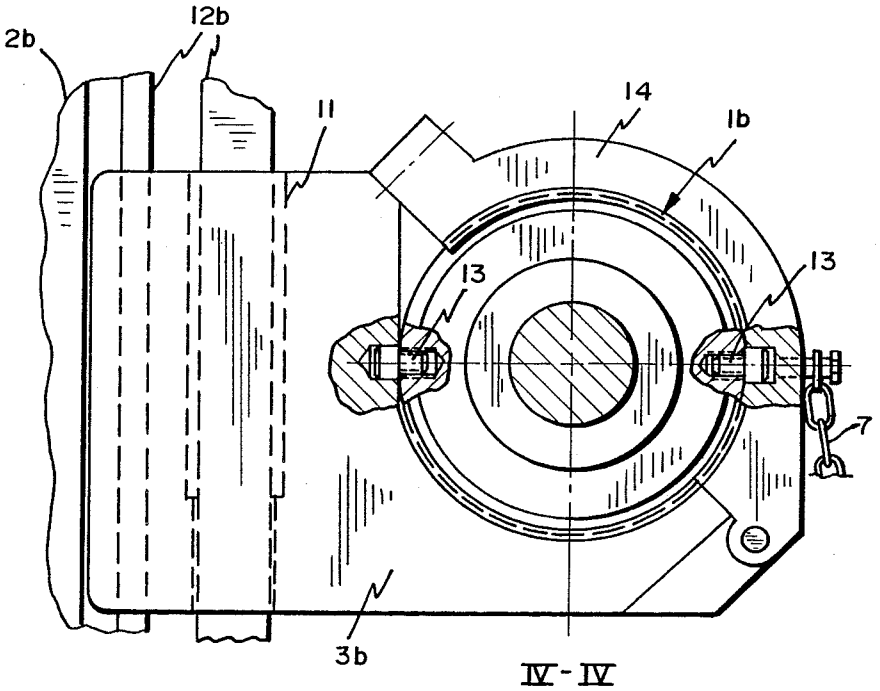
FIGS. 4*a* and 4*b* show a roll holder for the second end of a roll.
Figure 4A:
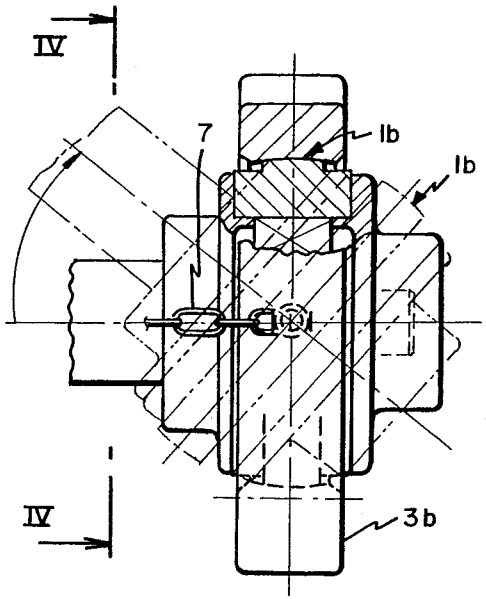

FIGS. 4a and 4b illustrate the structure of an operating side roll holder 3b , with FIG. 4a showing it in machine direction and FIG. 4b as viewed from the axial direction of a roll in plane IV—IV of FIG. 4a. At each bracket 2a and 2b the roll holder can be adapted to travel in an upright guide, respectively 12a and 12b, e.g. in a manner that the guide comprises a vertical transfer screw, fitted in the bracket and extending through a bore 11 having a matching internal thread and passing through the roll holder, as well as a guide rail which is mounted on the bracket, parallel to the transfer screw and in communication with a corresponding groove in the roll holder.

As shown in FIG. 4a, the external surface of roll bearing housing 1b is a section of a spherical surface and the internal surface of a roll holder surrounding this surface is contiguous to the above-mentioned surface. The bearing housing 1b is adapted to be rotatable in a vertical plane parallel to the axis of roll 1 by means of pivots 13 fixed on the opposite sides of the bearing housing and this action facilitates the tilting of roll 1 as the roll holder travels in its guide, this tilting or inclination being illustrated in FIG. 4a by dash-and-dot lines. Another advantage gained thereby is that pivots 13 make sure that the bearing housing is retained in the roll holder although a clearance between bearing housing and roll holder was to increase for some reason. FIG. 4b shows also how one end of a chain serving as a connecting member is secured to roll holder 3b at a pin in alignment with pivot 13.

Roll holder 3b can be opened by turning away a cover, indicated with reference numeral 14 in FIG. 4b and surrounding said bearing housing 1b on one side. A similar swinging cover is also mounted on service side roll holder 3a and positioned in a manner that, when the cover has been removed, bearing housing 1a is permitted to rise from the roll holder as the opposite roll holder 3b is being lowered and vice versa.

The present invention is not limited to just the embodiment shown on the drawings but it can be modified within the scope of an inventional idea set forth in the annexed claims. There are many structural alternatives for a roll supporting member. Similarly, it is possible to have also other press section rolls in power transmission with a hitch roll shifting motor.

I claim:

1. In a paper and board making machine including an endless press felt and a roll having a first and a second end, an apparatus for facilitating the replacement of the endless felt comprising:

a roll support positioned within a section between the two ends of the roll and against a mantle surface of the roll for supporting the roll;

means for shifting the first end of the roll around a fulcrum provided by said roll support from an initial position wherein the first end of the roll is in contact with the felt to a felt replacement position wherein the first end of the roll is away from the felt, the shifting movement being in a direction transverse to the longitudinal axis of the roll;

said means for shifting and said roll support being structured and arranged to cooperate for moving the second end of the roll around the fulcrum in the direction opposite to that of the first end movement and transverse to the longitudinal axis of the roll.

2. An apparatus according to claim 1, wherein said roll support is connected to a lever which is pivotably linked to a fixed fulcrum on a base structure.

3. An apparatus according to claim 2, wherein said roll support is linked by means of a connecting member to said second end of the roll.

4. An apparatus according to claim 3, wherein the connecting member is a tensile stress transmitting member.

5. An apparatus according to claim 4, wherein said tensile stress transmitting member is a chain or a cable.

6. An apparatus according to claim 2, wherein said apparatus includes an actuator in power transmitting communication with said second end of the roll for shifting it in a direction transverse to the longitudinal axis of the roll.

7. An apparatus according to claim 6, wherein the shift effecting actuator is a hitch roll shifting motor.

8. A method for facilitating replacement of an endless press felt in a paper and board making machine, including a roll having a first and second end, comprising the steps of: shifting by a shifting means, the first end of the roll from an initial position in contact with a press felt to a felt replacement position, in a direction transverse to the longitudinal axis of the roll for providing space for the replacement of a felt;

providing a support against a mantle surface of the roll within a section between the roll ends, swinging the roll around a fulcrum provided by said support such that the second end of the roll travels to a felt replacement position in a direction opposite to that of the movement of the first end of the roll and transverse to the longitudinal axis of the roll.

9. A method according to claim 8, wherein a new press felt is brought into contact with the roll by threading the new felt around the roll within a section between said first end and said support at said first end of the roll, with the first end having been shifted to a felt replacement position and cleared from a used press felt, and bringing the roll to the initial position and removing said support from contact with the roll, whereafter said felt is extended over the entire width of the roll and tensioned.

10. A method according to claim 8, wherein the position of said support member with respect to the second end of the roll is maintained constant during a shifting movement by means of a connecting member provided between said support member and the second end of the roll.

11. A method according to claim 8, wherein the traveling of the second end of the roll is effected by means of a hitch roll shifting motor.

12. A method according to claim 10, wherein said connecting member is a tensile stress transmitting member.

* * * * *